US011732845B1

(12) United States Patent
Xu et al.

(10) Patent No.: US 11,732,845 B1
(45) Date of Patent: Aug. 22, 2023

(54) ADAPTER AND LED LAMP USING THE ADAPTER

(71) Applicant: SHENZHEN SNC OPTO ELECTRONIC CO., LTD, Shenzhen (CN)

(72) Inventors: Jianyong Xu, Shenzhen (CN); Anle Zhao, Shenzhen (CN); Zhiyuan Li, Shenzhen (CN)

(73) Assignee: SHENZHEN SNC OPTO ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 18/098,724

(22) Filed: Jan. 19, 2023

(30) Foreign Application Priority Data

Oct. 24, 2022 (CN) ..... 202222819772.0

(51) Int. Cl.

| | |
|---|---|
| ***F21K 9/235*** | (2016.01) |
| ***H01R 24/54*** | (2011.01) |
| ***F21V 23/06*** | (2006.01) |
| *F21Y 115/10* | (2016.01) |

(52) U.S. Cl.
CPC ..... *F21K 9/235* (2016.08); *F21V 23/06* (2013.01); *H01R 24/542* (2013.01); *F21Y 2115/10* (2016.08)

(58) Field of Classification Search
CPC ..... F21K 9/235; F21V 23/06; H01R 24/542; F21Y 2115/10
See application file for complete search history.

(56) References Cited

U.S. PATENT DOCUMENTS

| | | | | |
|---|---|---|---|---|
| 2004/0066142 | A1* | 4/2004 | Stimac | F21K 9/238 315/56 |
| 2014/0273644 | A1* | 9/2014 | Mcsweyn | H01R 31/06 439/628 |
| 2016/0209017 | A1* | 7/2016 | Feller | F21S 8/00 |
| 2021/0388952 | A1* | 12/2021 | Wan | F21K 9/66 |

* cited by examiner

*Primary Examiner* — Evan P Dzierzynski

(57) ABSTRACT

The present disclosure provides an adapter and an LED lamp using the adapter, the adapter including a first body with an upper portion detachably connected with the LED lamp, and a lower portion opposite to the upper portion and detachably connected with an external electronic control member, a first electrical connection member fixedly installed on the upper portion, extending out of the upper portion and electrically connected to the LED lamp, a second electrical connection member fixedly installed between the upper and lower portions, with one end electrically connecting with the first electrical connection member and the other end connecting with the external electronic control member; the external electronic control member including a third electrical connection member electrically connected with the first electrical connection member by a conductive post and an elastic connecting member respectively formed thereof, which can connect with different external electronic control members by the adapter.

18 Claims, 9 Drawing Sheets

ADAPTER AND LED LAMP USING THE ADAPTER

BACKGROUND

1. Technical Field

The present disclosure generally relates to the field of lighting technologies, and especially relates to an adapter and an LED lamp using the adapter.

2. Description of Related Art

LED lamps have advantages of energy saving, a long life and being easy control, etc, which are in line with a global advocacy of energy conservation and emission reduction, and have been widely used in various lighting fields. In order to obtain better energy saving or a control effect, some conventional LED lamps are equipped with sensors, wireless controllers or other electronic control components that are configured to control the LED lamps. However, the conventional LED lamp can be only connected with the electronic control component with a single specification thereof, and dimensions and specifications of most lamp bodies or electronic control components produced by different countries or manufacturers are different, which makes a plurality of LED lamps unable to be simultaneously applied for other electronic control components with other specifications, resulting in greatly reducing a flexible usage of the LED lamp in other countries or regions, which is not conducive to a promotion and application of such LED lamp in the world. In this way, only different specifications of bodies of the LED lamps are needed to be produced to match different specifications of the electronic control components from different countries or manufacturers, which will lead to a significant increase in production costs.

SUMMARY

The technical problems to be solved: in view of the shortcomings of the related art, the present disclosure relates to an adapter and an LED lamp using the adapter which can connect with different external electronic control members by the adapter.

an adapter according to a first aspect of an embodiment of the present disclosure includes: a first body including an upper portion detachably connected with an LED lamp, and a lower portion opposite to the upper portion and configured to detachably connect with an external electronic control member;

a first electrical connection member fixedly installed on the upper portion and configured to electrically connect with the LED lamp;

a second electrical connection member fixedly installed between the upper portion and the lower portion, one end of the second electrical connection member electrically connected with the first electrical connection member, and the other end of the second electrical connection member electrically connected with the external electronic control member; and wherein the external electronic control member includes a third electrical connection member electrically connected with the first electrical connection member by the second electrical connection member, one of the first electrical connection member and the third electrical connection member including a conductive post arranged thereof, and the other of the first electrical connection member and the third electrical connection member including an elastic connecting member.

An LED lamp according to a second aspect of an embodiment of the present disclosure includes: a housing, an external electronic control member and an adapter; the adapter including a first body that includes an upper portion detachably connected with the housing, and a lower portion opposite to the upper portion and configured to detachably connect with the external electronic control member; a first electrical connection member electrically connected to the housing; a second electrical connection member with one end being electrically connected with the first electrical connection member, and the other end being electrically connected with the external electronic control member; and wherein the external electronic control member includes a third electrical connection member, one of the first electrical connection member and the third electrical connection member including a conductive post arranged thereof, and the other of the first electrical connection member and the third electrical connection member including an elastic connecting member.

The present disclosure provides the advantages as below: the present disclosure provides the adapter applied for the LED lamp, by setting the adapter of the present disclosure, the housing of the LED lamp can be connected with external electronic control members of different specifications, that is, in addition to the housing of the LED lamp itself can be connected with the external electronic control member with a specification, the housing can also be connected with another external electronic control member with another specification through the adapter, so that the LED lamp can be applied for the external electronic control members with different specifications in different countries. The external electronic control member can be an external electronic control component, such as a sensor or a wireless controller etc., externally connected to the housing, so as to control lighting, a color or a brightness of the LED lamp.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

Figure 1:
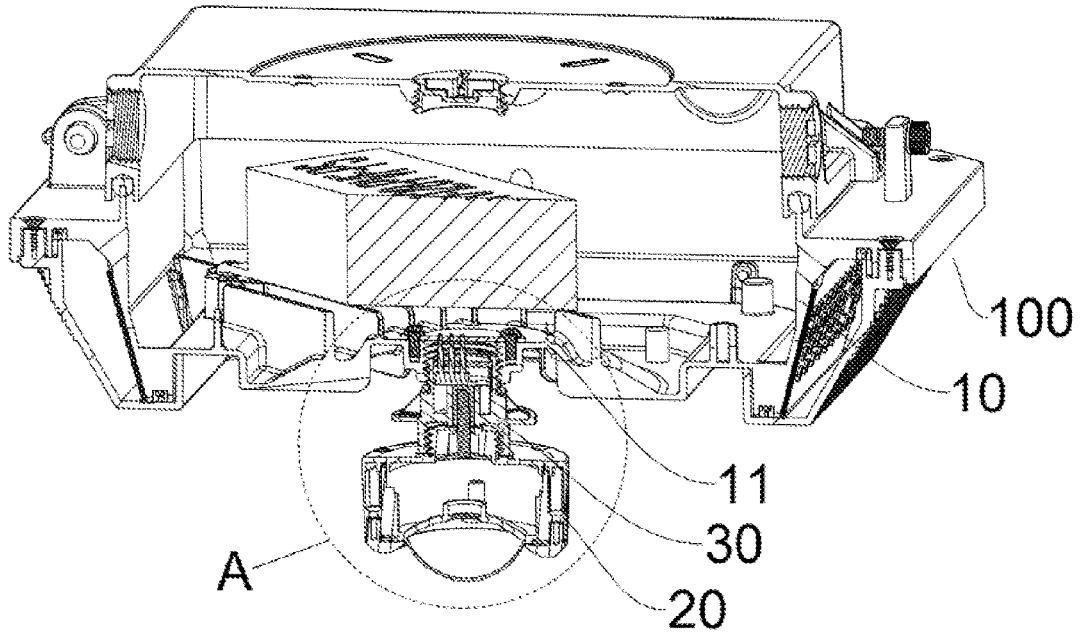
FIG. 1 is a schematic view of an LED lamp in accordance with an embodiment of the present disclosure.
Figure 2:
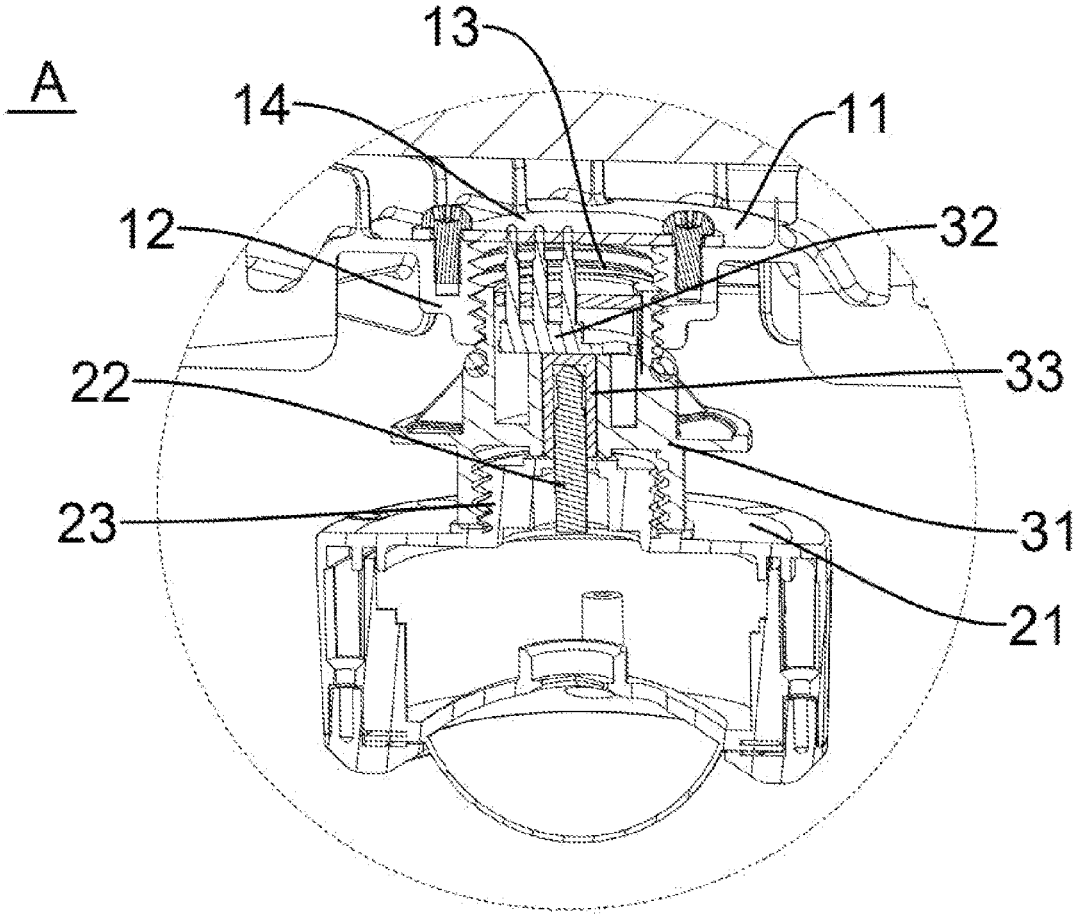
FIG. 2 is a partial enlarged view of a circle A of the LED lamp of FIG. 1.
Figure 3:
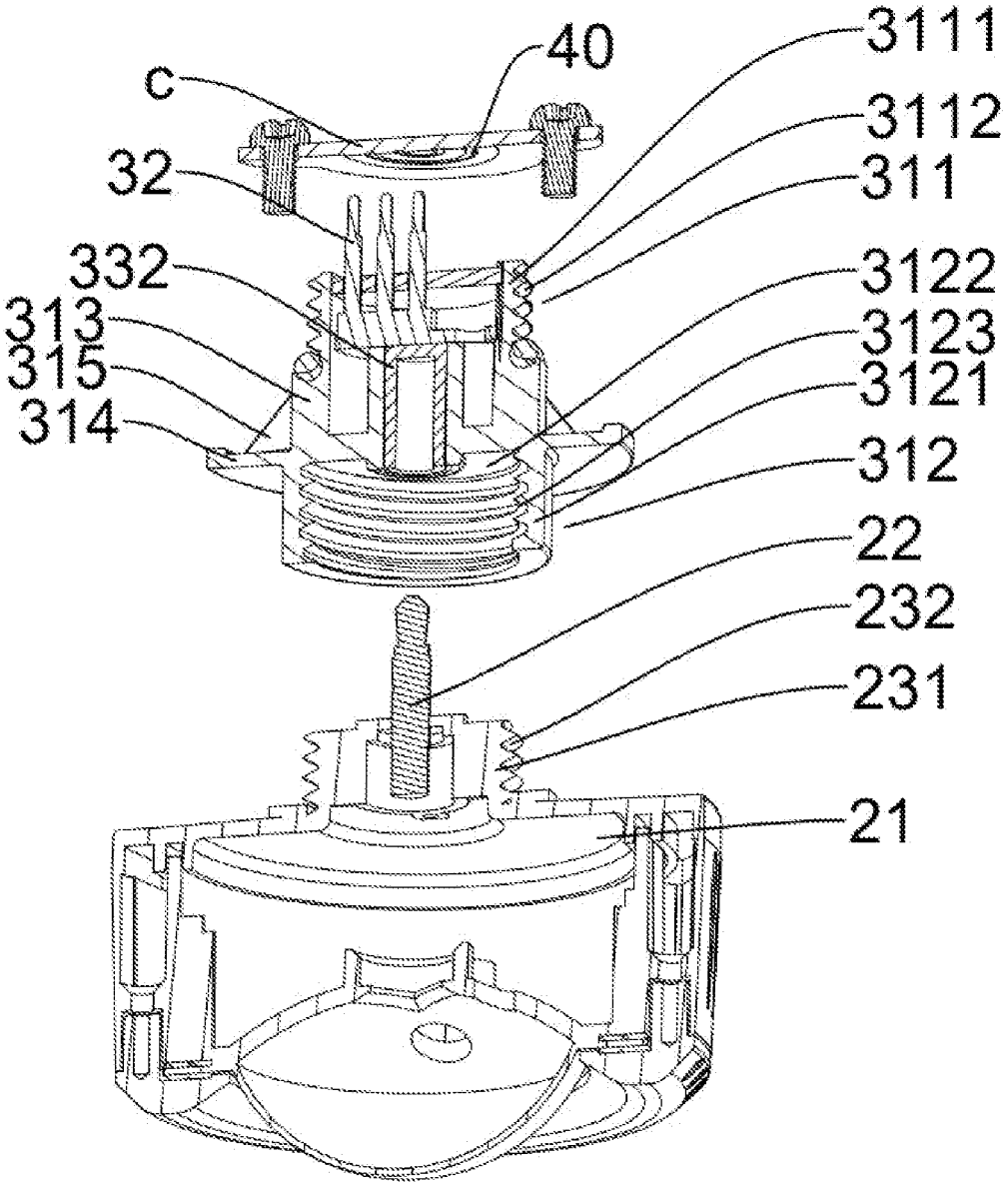
FIG. 3 is a schematic view of an adapter according to an embodiment of the present disclosure, which is connected with other components of the LED lamp of FIG. 1.
Figure 4:
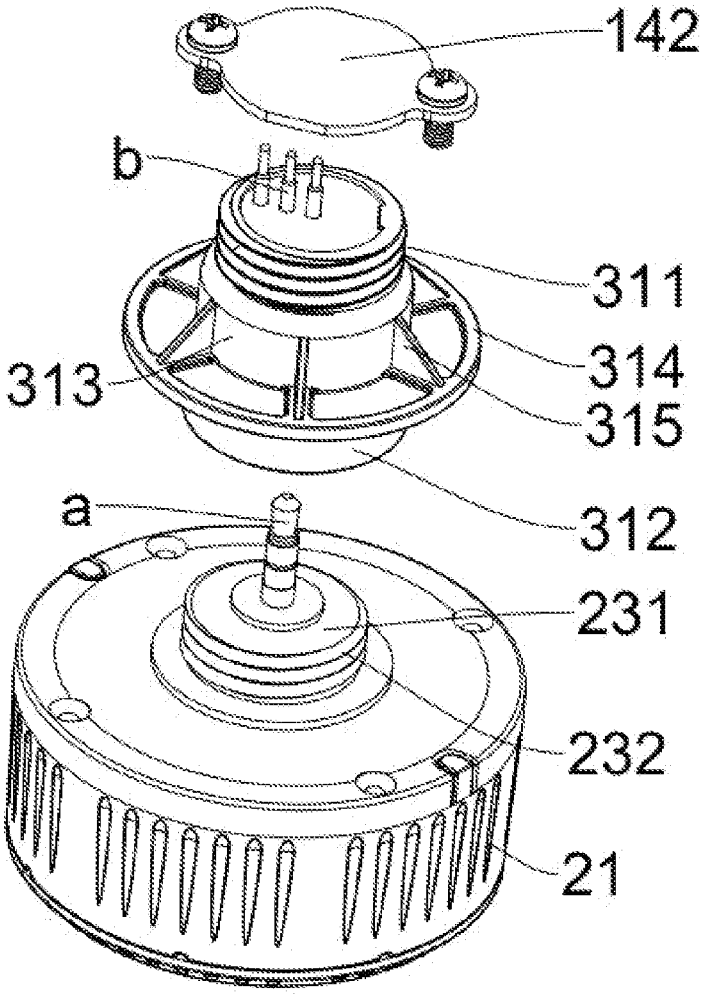
FIG. 4 is similar to FIG. 3, but shown from another view.
Figure 5:
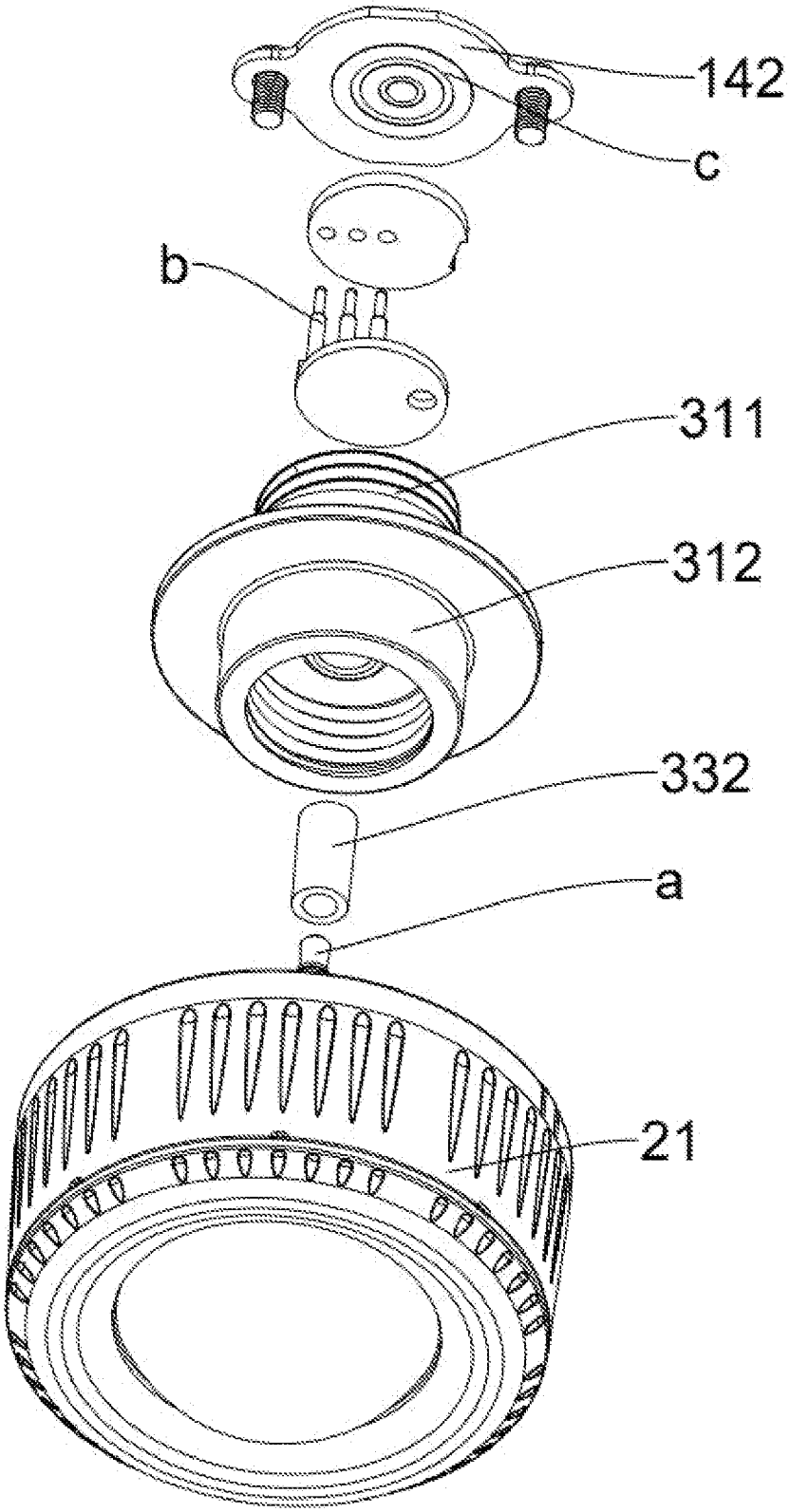
FIG. 5 is a partial exploded, schematic view of the LED lamp of FIG. 1.
Figure 6:
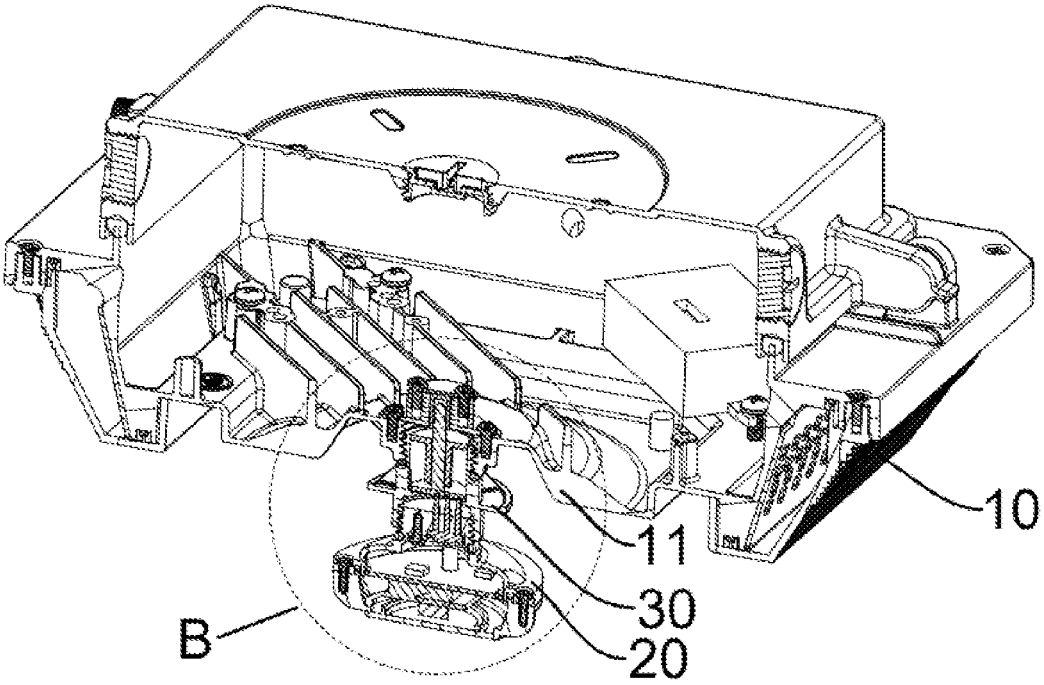
FIG. 6 is a schematic view of an LED lamp in accordance with another embodiment of the present disclosure.
Figure 7:
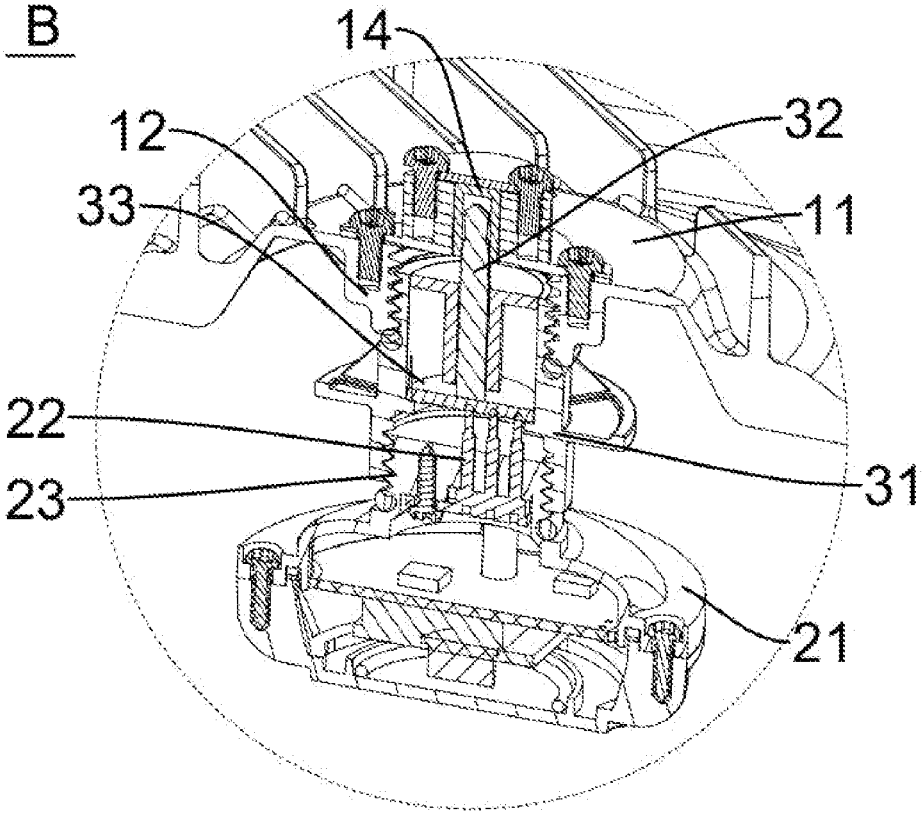
FIG. 7 is a partial enlarged view of a circle B of the LED lamp of FIG. 6.
Figure 8:
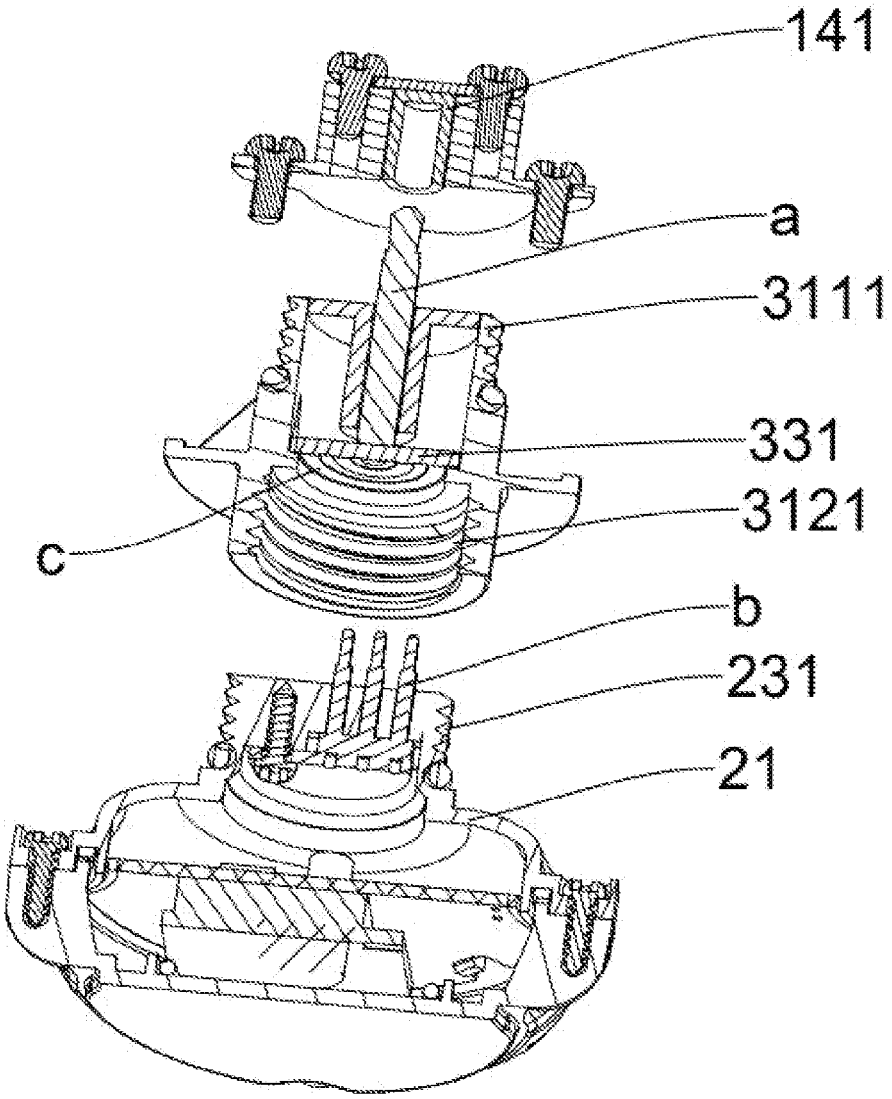
FIG. 8 is a schematic view of an adapter according to another embodiment of the present disclosure, which is connected with other components of the LED lamp of FIG. 6.
Figure 9:
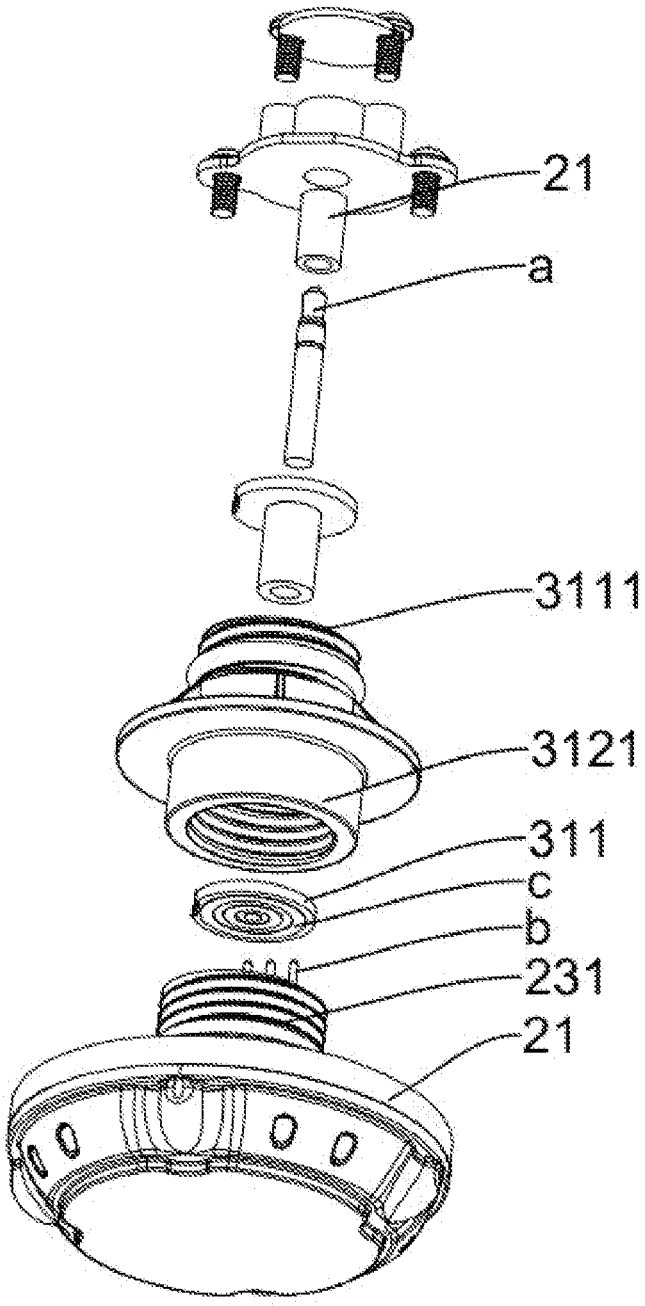
FIG. 9 is a partial exploded, schematic view of the LED lamp of FIG. 6.

The element labels according to the embodiment of the present disclosure shown as below:

100 LED lamp, 10 housing, 11 first case, 12 second body, 13 second installation member, 131 second annular wall, 132 second recess, 133 second screw thread, 14 fourth electrical connection member, 141 first inserting portion, 142 second circuit board, 20 external electronic control member, 21 second case, 22 third electrical connection member, 23 first installation member, 231 second protrusion, 232 fourth screw thread, 30 adapter, 31 first body, 311 upper portion, 3111 first protrusion, 3112 first screw thread, 312 lower portion, 3121 first annular wall, 3122 first recess, 3123 third screw thread, 313 first annular step, 314 second annular step, 315 stiffener, 32 first electrical connection member, 33 second electrical connection member, 331 first circuit board, 332 second inserting portion, a conductive post, b elastic connecting member, c circular conductive ring, e buckle groove, f fastener.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described exemplary embodiment of the present disclosure, all other embodiments obtained by one of ordinary skill in the related art on the premise of no creative work are within the protection scope of the present disclosure.

It should also be understood that the terms used in the specification of the present disclosure are only for the purpose of describing specific embodiments without being intended to limit the present disclosure. As used in the description of the present disclosure and the appended claims, terms of "one", "one" and "the" in a singular form are intended to include a plural form unless the context clearly indicates otherwise.

It should also be further understood that the term "and/or" used in the description of the present disclosure and the appended claims refers to any combination of one or more of associated listed items and all possible combinations, and includes these combinations.

Referring to FIGS. 1-9, an adapter 30 in accordance with an embodiment of the present disclosure is applied for an LED lamp 100 and includes a first body 31, a first electrical connection member 32 and a second electrical connection member 33. The first body 31 includes an upper portion 311 detachably connected with the LED lamp 100, and a lower portion 312 opposite to the upper portion 311 and detachably connected with an external electronic control member 20. The first electrical connection member 32 is fixedly installed on the upper portion 311 and configured to electrically connect with the LED lamp 100. The second electrical connection member 33 is fixedly installed between the upper portion 311 and the lower portion 312, one end of the second electrical connection member 33 is electrically connected with the first electrical connection member 32, and the other end of the second electrical connection member 33 is electrically connected with the external electronic control member 20.

The external electronic control member 20 includes a third electrical connection member 22 electrically connected with the first electrical connection member 32, one of the first electrical connection member 32 and the third electrical connection member 22 including a conductive post a arranged thereof, and the other of the first electrical connection member 32 and the third electrical connection member 22 including an elastic connecting member b. Both ends of the adapter 30 of the present disclosure are detachably connected with the LED lamp 100 and the external electronic control member 20, respectively, and electrical connection between the LED lamp 100 and the external electronic control member 20 is obtained through the first electrical connection member 32 and the second electrical connection member 33. The LED lamp 100 of the present disclosure can be connected with the external electronic control member 20 with a specification, and another external electronic control member 20 with another specification can be also connected with the LED lamp 100 through the adapter 30, so as to obtain a purpose of wider applicability of the LED lamp 100.

In an optical embodiment of the present disclosure, the upper portion 311 includes a first protrusion 3111 that includes a first screw thread 3112 formed on an outer surface thereof. The LED lamp 100 includes a second screw thread 133 matched with the first screw thread 3112, and the LED lamp 100 can be detachably connected with the first protrusion 311 by the first screw thread 3112 engaging with the second screw thread 133. The lower portion 312 includes a first annular wall 3121 with a first recess 3122 thereof, a third screw thread 3123 arranged on an inner surface of the first annular wall 3121. The external electronic control member 20 includes a fourth screw thread 232 matched with the second screw thread 133, so that the first annular wall 3121 is detachably connected with the external electronic control member 20 by the third screw thread 3123 engaging with the fourth screw thread 232.

Figure 10:
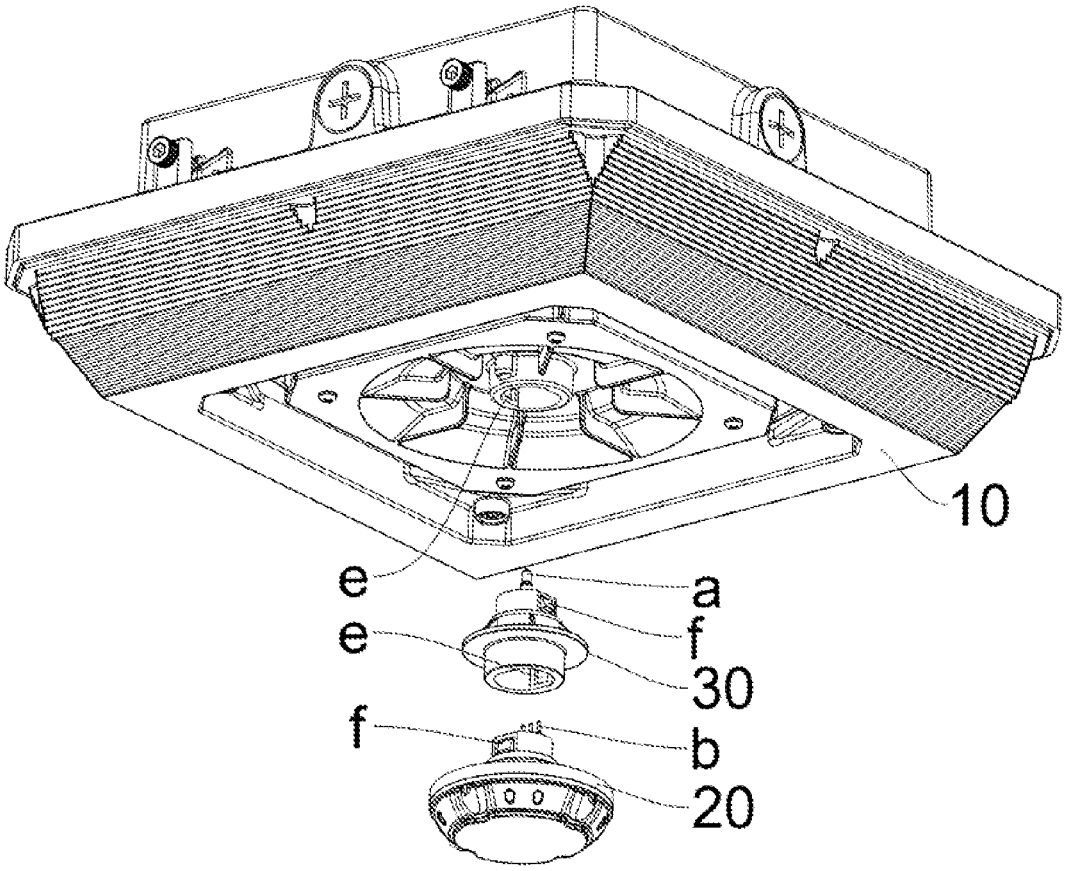
FIG. 10 is an exploded, schematic view of the LED lamp of FIG. 1.
Figure 11:
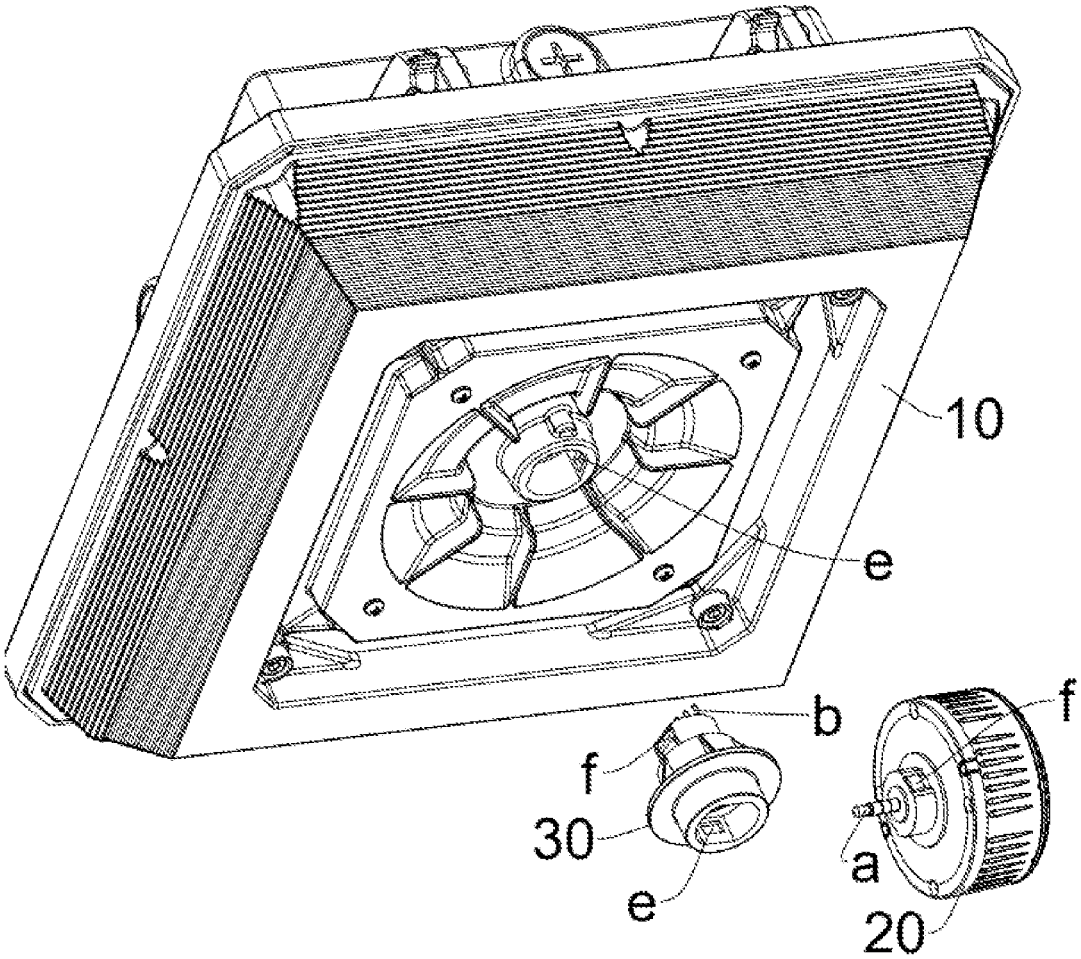
FIG. 11 is an exploded, schematic view of the LED lamp of FIG. 6.

In some embodiments of the present disclosure, referring to FIG. 10 and FIG. 11, the LED lamp 100 and the first protrusion 3111 can also be detachably connected with each other by a buckle groove e and a fastener f, and the external electronic control member 20 and the adapter 30 can also be detachably connected with each other by the buckle groove e and the fastener f.

In an optical embodiment of the present disclosure, the first body 31 includes a first annular step 313 arranged close to the first protrusion 3111, and a second annular step 314 arranged close to the first annular 3121. A diameter of the second annular step 314 is larger than that of the first annular step 313, and a plurality of stiffeners 315 is arranged between the first annular step 313 and the second annular step 314.

Specifically, all the first annular step 313, the second annular step 314 and the first protrusion 3111 are coaxially arranged, and the first protrusion 3111 is adjacent to the first annular step 313. The plurality of stiffeners 315 is arranged to strengthen mechanical strength between the first annular step 313 and the second annular step 314, so as to increase structural stability of the adapter 30.

Referring to FIG. 6 to FIG. 9, in an optical embodiment of the present disclosure, the first electrical connection member 32 is a single conductive post a, and the third electrical connection member 22 includes a plurality of elastic connecting members b arranged side by side, the second electrical connection member 33 is a first circuit board 331 with one side electrically connecting to the first electrical connection member 32, and the other side including a plurality of circular conductive rings 331 arranged coaxially.

Specifically, in an embodiment of the present disclosure, the adapter 30 is configured to convert the elastic connecting member b with a single conductive-column type into a plurality of parallel elastic connecting members b. The LED lamp 100 itself can be directly connected to the external electronic control member 20 of a single conductive-column type (i.e., a single conductive-column type connecting member), and the external electronic control member 20 with the single conductive-column type can be converted to connect with the external electronic control member 20 with the plurality of parallel types through the adapter 30. Therefore, the adapter 30 can be connected to the external electronic control member 20 with the plurality of parallel elastic connecting members.

The LED lamp 100 includes a fourth electrical connection member 14 that is a first inserting portion 141, and the conductive post a is inserted into the first inserting portion 141 so that the adapter 30 is electrically connected to the LED lamp 100. The plurality of elastic connecting members b arranged in parallel is correspondingly abutted against the plurality of circular conductive rings c, so that the adapter 30 is electrically connected to the external electronic control member 20, so as to electrically connect the LED lamp 100 and the external electronic control member 20. The innermost one of the plurality of elastic connecting members b is coaxial with an axis of the first annular wall 3121, and each of other elastic connecting members b is respectively abutted against a circle of circular conductive rings c, after the external electronic control member 20 is screwed into the first recess 3122, each elastic connecting member b can be abutted against each circle of conductive rings c, which can also ensure connection stability between the external electronic control member 20 and the first circuit board 331. The elastic connecting member b can be an elastic thimble.

Referring to FIG. 1 to FIG. 5, in another embodiment of the present disclosure, the first electrical connection member 32 includes a plurality of elastic connecting members b arranged side by side, the third electrical connection member 22 is a single conductive post a, and the second electrical connection member 33 is a second inserting portion 332, one end of the second inserting portion 332 electrically connected to the first electrical connection member 32, and the single conductive post a inserted into the other end of the second inserting portion 332.

The adapter 30 of the embodiment is configured to convert the adapter 30 with the plurality of elastic connecting members b into the adapter 30 with the single conductive-column type to match the single external electronic control member 20. The LED lamp 100 itself can be connected with the external electronic control member 20 with the plurality of connecting members, so that the LED lamp 100 can be connected with different external electronic control members 20. The LED lamp 100 includes the fourth electrical connection member 14 that is the second circuit board 142, the plurality of coaxial circular conductive rings c arranged on a side of the second circuit board 142 towards the plurality of elastic connecting members b, so as to electrically connect the adapter 30 and the LED lamp 100 by the plurality of elastic connecting members b correspondingly abutting with the plurality of circular conductive rings c.

An LED lamp 100 according to an embodiment of the present disclosure is provided and includes a housing 10, an external electronic control member 20 and an adapter 30. The upper portion 311 of the adapter 30 is detachably connected with the housing 10 and the lower portion 312 of the adapter 30 is detachably connected with the external electronic control member 20. The adapter 30 includes a first electrical connection member 32 provided to electrically connect the adapter 30 to the housing 10, and a second electrical connection member 33 provided to electrically connect the adapter 30 and the external electronic control member 20. The LED lamp 100 of the present disclosure can be connected with the external electronic control member 20 with a specification, and another external electronic control member 20 with another specification can be also connected with the LED lamp 100 through the adapter 30, so as to obtain a purpose of wider applicability of the LED lamp 100.

In an embodiment of the present disclosure, the housing 10 includes a first case 11 including a second body 12 formed thereof. The second body 12 includes or connects to a second installation member 13 and a fourth electrical connection member 14. The second installation member 13 is detachably connected with the upper portion 311, and the fourth electrical connection member 14 is electrically connected with the first electrical connection member 32.

The external electronic control member 20 includes a second case 21 formed thereof. The second case 21 includes or connects to the third electrical connection member 22 and a first installation member 23, the first installation member 23 detachably connected with the lower portion 312, and the third electrical connection member 22 electrically connected to the second electrical connection member 33.

The upper portion 311 of the adapter 30 includes a first protrusion 3111 including a first screw thread 3112 formed on an outer surface thereof. The second installation member 13 includes a second annular wall 131 with a second recess 132 being formed thereof, a second screw thread 133 arranged on an inner surface of the second annular wall 131 and matched with the first screw thread 3112. In this way, the housing 10 can be detachably connected with the adapter 30 by the first screw thread 3112 engaging with the second screw thread 133. In some embodiments, the adapter 30 and the housing 10 can also be detachably connected with each other through a hook or a clamping slot.

The lower portion 312 of the adapter 30 includes a first annular wall 3121 with a first recess 3122 thereof, a third screw thread 3123 arranged on an inner surface of the first annular wall 312. The first installation member 23 includes a second protrusion 231 inserted into the first recess 3122, a fourth screw thread 232 arranged on an outer surface of the second protrusion 231 and matched with the third screw thread 3123, in this way, the adapter 30 can be electrically connected to the external electronic control member 20 by the third screw thread 3123 engaging with the fourth screw thread 232. In some embodiments, the adapter 30 and the housing 10 can also be detachably connected with each other through the hook or the clamping slot.

In an optical embodiment of the present disclosure, the first electrical connection member 32 is the single conductive post a, and the third electrical connection member 22 includes the plurality of elastic connecting members b arranged side by side. The fourth electrical connection member 14 is the first inserting portion 141, the conductive post a inserted into the first inserting portion 141 so as to electrically connect the LED lamp 100 to the adapter 30. The second electrical connection member 33 is the first circuit board 331 with one side electrically connecting to the conductive post a, and the other side including the plurality of circular conductive rings c arranged coaxially, the plurality of elastic connecting members b correspondingly abutted against the plurality of circular conductive rings c so as to electrically connect the adapter 30 to the external electronic control member 20. The third electrical connection member 22 can be three elastic connecting members b arranged side by side. The embodiment of the present disclosure is used to convert a single pin into three pins. The LED lamp 100 itself can adapt to the external electronic control member 20 of a single pin. Through the adapter 30, the external electronic control member 20 of three pins can also be adapted.

In another embodiment of the present disclosure, the first electrical connection member 32 includes the plurality of elastic connecting members b arranged side by side, and the third electrical connection member 22 is the single conductive post. The second electrical connection member 33 is the second inserting portion 332, one end of the second inserting portion 332 electrically connected to the elastic connecting member b, the single conductive post inserted into the other end of the second inserting portion 332, so as to electrically connect the external electronic control member 20 with a single pin to the adapter 30. The fourth electrical connection member 14 is the second circuit board 142, the plurality of coaxial circular conductive rings c arranged on the side of the second circuit board 142 towards the plurality of elastic connecting members b, and the plurality of elastic connecting members b correspondingly abutted against the plurality of circular conductive rings c, so as to electrically connect the LED lamp 100 and the adapter 30. The first electrical connection member 32 can be three elastic connecting members b. The embodiment of the present disclosure is used to convert the three pins into a single pin. The LED lamp 100 itself can adapt to the external electronic control member 20 of the three pins, and the external electronic control member 20 of the single pin can also be adapted through the adapter 30.

In an optical embodiment of the present disclosure, the external electronic control member 20 can be selected from one of a sensor and a wireless controller.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. An adapter comprising:

a first body comprising an upper portion detachably connected with an LED lamp, and a lower portion opposite to the upper portion and configured to detachably connect with an external electronic control member;

a first electrical connection member fixedly installed on the upper portion, extending out of the upper portion and configured to electrically connect with the LED lamp;

a second electrical connection member fixedly installed between the upper portion and the lower portion, one end of the second electrical connection member electrically connected with the first electrical connection member, and the other end of the second electrical connection member electrically connected with the external electronic control member; and wherein the external electronic control member comprises a third electrical connection member electrically connected with the first electrical connection member by the second electrical connection member, one of the first electrical connection member and the third electrical connection member comprising a conductive post arranged thereof, and the other of the first electrical connection member and the third electrical connection member comprising an elastic connecting member.

2. The adapter as claimed in claim 1, wherein the first electrical connection member is a single conductive post, and the third electrical connection member comprises a plurality of elastic connecting members arranged side by side, the LED lamp comprising a fourth electrical connection member that is a first inserting portion, the conductive post inserted into the first inserting portion; the second electrical connection member is a first circuit board with one side electrically connecting to the first electrical connection member, and the other side comprising a plurality of circular conductive rings arranged coaxially, the plurality of elastic connecting members correspondingly abutted against the plurality of circular conductive rings.

3. The adapter as claimed in claim 1, wherein the first electrical connection member comprises a plurality of elastic connecting members arranged side by side, the third electrical connection member is a single conductive post, and the second electrical connection member is a second inserting portion, one end of the second inserting portion electrically connected to the first electrical connection member, the single conductive post inserted into the other end of the second inserting portion; the LED lamp comprising a fourth electrical connection member that is a second circuit board, a plurality of circular conductive rings coaxially arranged on a side of the second circuit board towards the plurality of elastic connecting members, and the plurality of elastic connecting members correspondingly abutted against the plurality of circular conductive rings.

4. The adapter as claimed in claim 1, wherein the upper portion comprises:

a first protrusion comprising a first screw thread formed on an outer surface thereof;

the LED lamp comprising a second screw thread matched with the first screw thread, and the LED lamp detachably connected with the first protrusion by the first screw thread engaging with the second screw thread;

the lower portion comprising:

a first annular wall with a first recess thereof, a third screw thread arranged on an inner surface of the first annular wall; and wherein the external electronic control member comprises a fourth screw thread matched with the second screw thread, the first annular wall detachably connected with the external electronic control member by the third screw thread engaging with the fourth screw thread.

5. The adapter as claimed in claim 4, wherein the first body comprises a first annular step and a second annular step coaxial with the first protrusion, the first annular step arranged close to the first protrusion, and the second annular step arranged close to the first annular wall.

6. The adapter as claimed in claim 5, wherein a diameter of the second annular step is larger than that of the first annular step, and a plurality of stiffeners is arranged between the first annular step and the second annular step.

7. The adapter as claimed in claim 4, wherein the plurality of elastic connecting members is a plurality of elastic thimbles, one of the plurality of elastic thimbles is coaxial with the first annular wall.

8. The adapter as claimed in claim 7, wherein the plurality of elastic thimbles is arranged side by side.

9. The adapter as claimed in claim 1, wherein the plurality of elastic connecting members is a plurality of elastic thimbles, a central axis of the plurality of elastic thimbles is parallel to a central axis of the first annular wall.

10. The adapter as claimed in claim 1, wherein the conductive post is a single earphone plug.

11. The LED lamp as claimed in claim 10, wherein the housing comprises a first case comprising a second body formed thereof, the second body comprising a second installation member detachably connected with the upper portion, and a fourth electrical connection member electrically connected with the first electrical connection member.

12. The LED lamp as claimed in claim 10, wherein the external electronic control member comprises a second case that comprises a first installation member, the third electrical connection member connected with the second case and electrically connected to the second electrical connection member, and the first installation member detachably connected with the lower portion.

13. The LED lamp as claimed in claim 12, wherein the first electrical connection member is a single conductive post, the third electrical connection member comprises a plurality of elastic connecting members arranged side by side, and the fourth electrical connection member is a first inserting portion, the conductive post inserted into the first inserting portion; the second electrical connection member is a first circuit board with one side electrically connecting to the first electrical connection member, and the other side comprising a plurality of circular conductive rings arranged coaxially.

14. The LED lamp as claimed in claim 12, wherein the first electrical connection member comprises a plurality of elastic connecting members arranged side by side, the third electrical connection member is a single conductive post, and the second electrical connection member is a second inserting portion, one end of the second inserting portion electrically connected to the first electrical connection member, the single conductive post inserted into the other end of the second inserting portion; the fourth electrical connection member is a second circuit board, a plurality of circular conductive rings coaxially arranged on a side of the second circuit board towards the plurality of elastic connecting members, and the plurality of elastic connecting members correspondingly abutted against the plurality of circular conductive rings.

15. The LED lamp as claimed in claim 12, wherein the upper portion comprises a first protrusion comprising a first screw thread, and the second installation member comprises a second annular wall with a second recess thereof, and the second annular wall comprising a second screw thread matched with the first screw thread.

16. An LED lamp comprising:

a housing;

an external electronic control member;

an adapter comprising:

a first body comprising an upper portion detachably connected with the housing, and a lower portion opposite to the upper portion and configured to detachably connect with an external electronic control member;

a first electrical connection member electrically connected to the housing;

a second electrical connection member with one end being electrically connected with the first electrical connection member, and the other end being electrically connected with the external electronic control member; and wherein the external electronic control member comprises a third electrical connection member, one of the first electrical connection member and the third electrical connection member comprising a conductive post arranged thereof, and the other of the first electrical connection member and the third electrical connection member comprising an elastic connecting member.

17. The LED lamp as claimed in claim 16, wherein the lower portion comprises a first annular wall with a first recess thereof and a third screw thread thereof; the first installation member comprising a second protrusion inserted into the first recess, and the second protrusion comprising a fourth screw thread matched with the third screw thread.

18. The LED lamp as claimed in claim 16, wherein the external electronic control member is selected from one of a sensor and a wireless controller.

* * * * *